US006893317B1

(12) United States Patent
Vlodek

(10) Patent No.: US 6,893,317 B1
(45) Date of Patent: May 17, 2005

(54) STORYBOOK LANTERN

(76) Inventor: James Vlodek, 10950 Linn Ct., La Grange, IL (US) 60525

( * ) Notice: Subject to any disclaimer, the term of this patent is extended or adjusted under 35 U.S.C. 154(b) by 0 days.

(21) Appl. No.: 10/742,468

(22) Filed: Dec. 19, 2003

(51) Int. Cl.[7] ..... A63H 33/38; A63H 1/00; A63H 1/24; A47B 49/00

(52) U.S. Cl. ..... 446/147; 446/236; 446/242; 40/377

(58) Field of Search ..... 446/236, 242, 446/71, 147, 73, 76, 175; 40/377, 493, 484, 40/482; 434/401, 402, 404, 428

(56) References Cited

U.S. PATENT DOCUMENTS

| | | | | |
|---|---|---|---|---|
| 1,177,873 | A * | 4/1916 | Kraus | 40/493 |
| 3,729,837 | A | 5/1973 | Tarnopolsky et al. | |
| 3,795,989 | A | 3/1974 | Greenberg et al. | |
| 3,796,806 | A | 3/1974 | Sanford | |
| 3,959,903 | A * | 6/1976 | Shneider | 40/377 |
| 4,049,330 | A * | 9/1977 | Schlapp | 312/186 |
| 4,288,537 | A | 9/1981 | Knetzger | |
| 4,403,965 | A | 9/1983 | Hawkins | |
| 4,752,230 | A | 6/1988 | Shimizu | |
| 4,778,391 | A | 10/1988 | Weiner | |
| 4,990,092 | A | 2/1991 | Cummings | |
| 5,087,043 | A | 2/1992 | Billings et al. | |
| 5,088,928 | A | 2/1992 | Chan | |
| 5,127,869 | A | 7/1992 | Hanzawa | |
| 5,161,977 | A | 11/1992 | Thomas, Jr. | |
| 5,188,533 | A | 2/1993 | Wood | |
| 5,209,665 | A | 5/1993 | Billings et al. | |
| 5,275,285 | A | 1/1994 | Clegg | |
| 5,561,929 | A * | 10/1996 | Bell et al. | 40/379 |
| 5,569,868 | A | 10/1996 | Leung | |
| 5,987,795 | A * | 11/1999 | Wilson | 40/658 |
| 5,988,684 | A * | 11/1999 | Blaustein et al. | 281/15.1 |
| 6,210,248 | B1 * | 4/2001 | McAdam | 446/147 |
| 6,296,127 | B1 * | 10/2001 | Tseng | 211/45 |
| 6,544,096 | B1 * | 4/2003 | Pyrce et al. | 446/268 |
| 6,697,602 | B1 * | 2/2004 | Ferrigno et al. | 434/308 |

* cited by examiner

*Primary Examiner*—Derris H. Banks
*Assistant Examiner*—Faye Francis
(74) *Attorney, Agent, or Firm*—Perry Hoffman

(57) ABSTRACT

The device provides auditory and visual stimulation to an infant or young child. The device includes a themed housing with a base portion and an upper portion. The base portion includes electronic circuitry and a drive mechanism. The upper portion houses a plurality of planar members that are drivably co-engaged. The floor of the upper portion includes a plurality of grooves in which the planar members travel, a microswitch arrangement for identifying which planar members are viewable, and a slot through which a driving member engages the planar members. The upper portion includes two or more lights for selectively illuminating the viewable planar members.

20 Claims, 7 Drawing Sheets

STORYBOOK LANTERN

FIELD OF THE INVENTION

The invention relates in general to a toy. More particularly, the invention relates to an interactive toy that provides auditory and visual stimulation to an infant or young child, and also serves as a nightlight.

BACKGROUND OF THE INVENTION

Experts agree that the benefits of reading aloud to children from an early age are numerous. Reading aloud helps a child develop imagination, knowledge and vocabulary, as well as a love of books and reading. Additionally, reading aloud allows a reader and child to bond and enjoy "quality time" together. What better quality time can be found than getting lost in a book together? These are treasured times with the children in our lives.

Young children especially enjoy being read to at bedtime. Many children look forward to and rely on repetitive bedtime rituals that include reading one or more favorite stories or books. People with young children are familiar with the request "please read me a story" which is often accompanied by a picture book that delivers the child into a world of fantasy that often includes princesses, brave heroes, fairy godmothers, mystical creatures, and the like. Many children like to take an active roll in reading by holding the book, turning the pages, or otherwise assisting the reader.

Many different types of books have been developed for toddlers or other young children that facilitate the love of reading. One type of book is known as a "chunky" board book. Such books have thick pages that are easy for small hands to manipulate, and prevent the occurrence of paper cuts. Other types of child-friendly books include a cloth book that has soft, pliant fabric pages, and a bath-time book wherein the pages are formed by sandwiching and sealing a foam or like material between water resistant plastic or rubber panels. Although the aforementioned books are safe and well established for enjoyment by toddlers and other preschool-aged children, they are inappropriate for infants since they could present a choking hazard when chewed upon.

In view of the foregoing, a safe storybook device for an infant or young child is needed. It is desirable that the device be easily manipulated by an infant or other young child with some degree of dexterity, present various selectable stories, and provide auditory and visual stimulation. Moreover, it is desirable to illuminate the device for bedtime use.

BRIEF SUMMARY OF THE INVENTION

The inventive device provides auditory and visual stimulation to an infant or young child. The device includes a themed housing with a base portion and an upper portion. The base portion includes electronic circuitry and a drive mechanism. The upper portion houses a plurality of planar members that are drivably co-engaged about a central spindle. The floor of the upper portion includes a plurality of concentric grooves in which each of the planar members travels, a microswitch arrangement disposed in the grooves, and a slot through which a driving member of the drive mechanism engages the planar members. The upper portion includes two or more lights for selectively illuminating the viewable surfaces of the planar members.

BRIEF DESCRIPTION OF THE DRAWINGS

The present invention is described with reference to the accompanying figures, which illustrate embodiments of the present invention. However, it should be noted that the invention as disclosed in the accompanying figures is illustrated by way of example only. In the drawings, wherein like reference numerals indicate like parts.

DETAILED DESCRIPTION OF THE EMBODIMENTS

Figure 1:
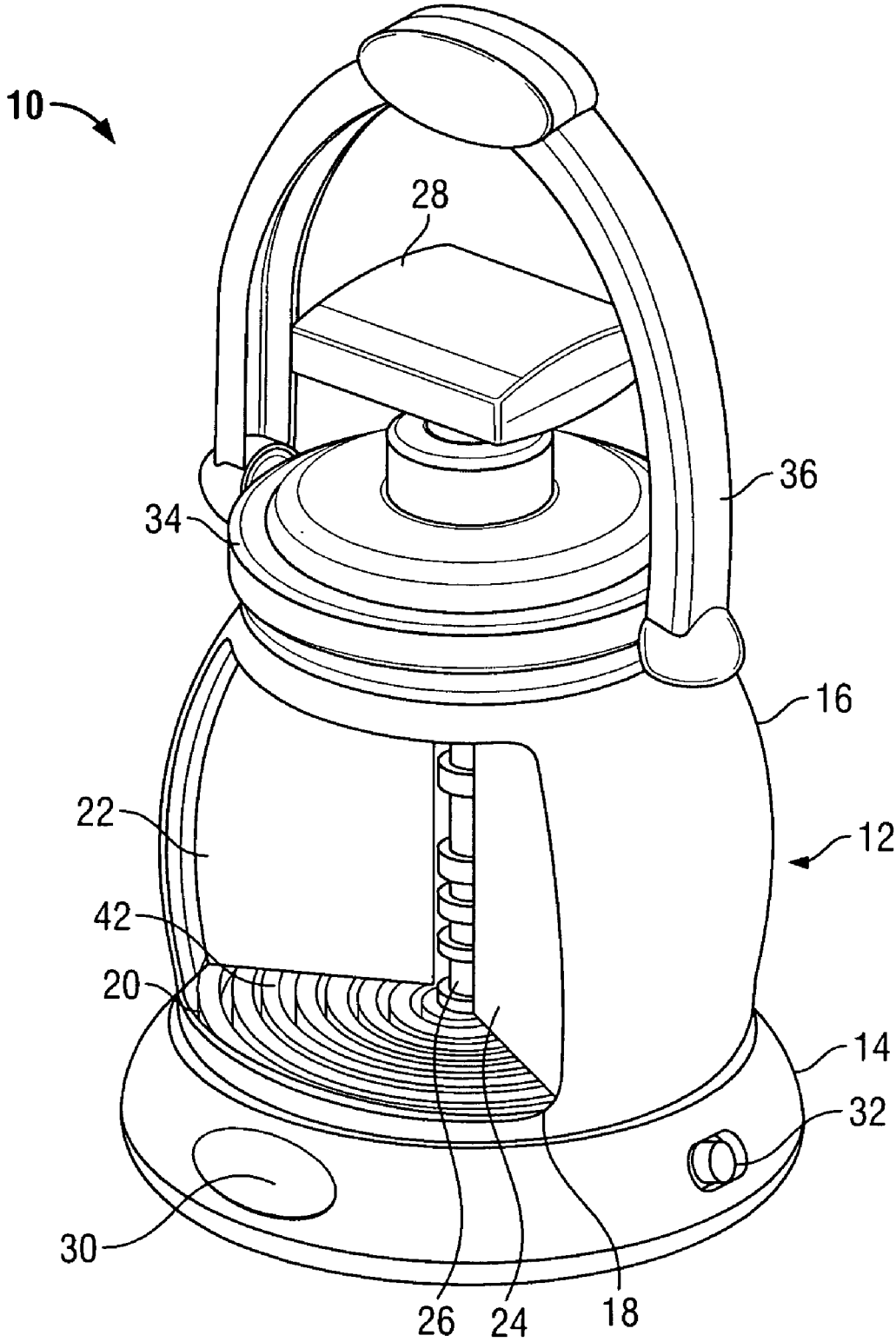
FIG. 1 is a perspective view of a first exemplary embodiment of the interactive toy.

Referring now to the Figures and particularly to FIG. 1, the first exemplary embodiment of a themed interactive toy is shown. The toy 10 includes a housing 12 shaped to replicate a lantern. The housing 12 includes a base portion 14, a top portion 16, a cap 34, a carrying handle 36 and a movable themed plunger 28. Disposed within the top portion 16 of the housing 12 is a spindle 26, which is generally cylindrical and spans the height of top portion 16. A plurality of planar members are drivably co-engaged about the spindle 26. Each planar member includes a first and second side for displaying images or indicia relative to the toy theme.

As it is desirable to display only one or two planar members at a time, the top portion 16 is substantially opaque to hide the remaining planar members and other internal mechanisms of the toy 10. The top portion 16 includes a viewing portion 18 that is sized and shaped to display the desired number of viewable planar members. As shown in FIG. 1, the viewing portion 18 is sized and shaped to display a first side of a first planar member 22 and a second side of a second planar member 24. The viewing portion 18 may allow access to the planar members to, for example, customize the images or indicia thereon. Alternatively, the viewing portion 18 may include a generally clear or translucent window for sealing the top portion 16 such as window 46 as shown in FIG. 2.

Figure 2:
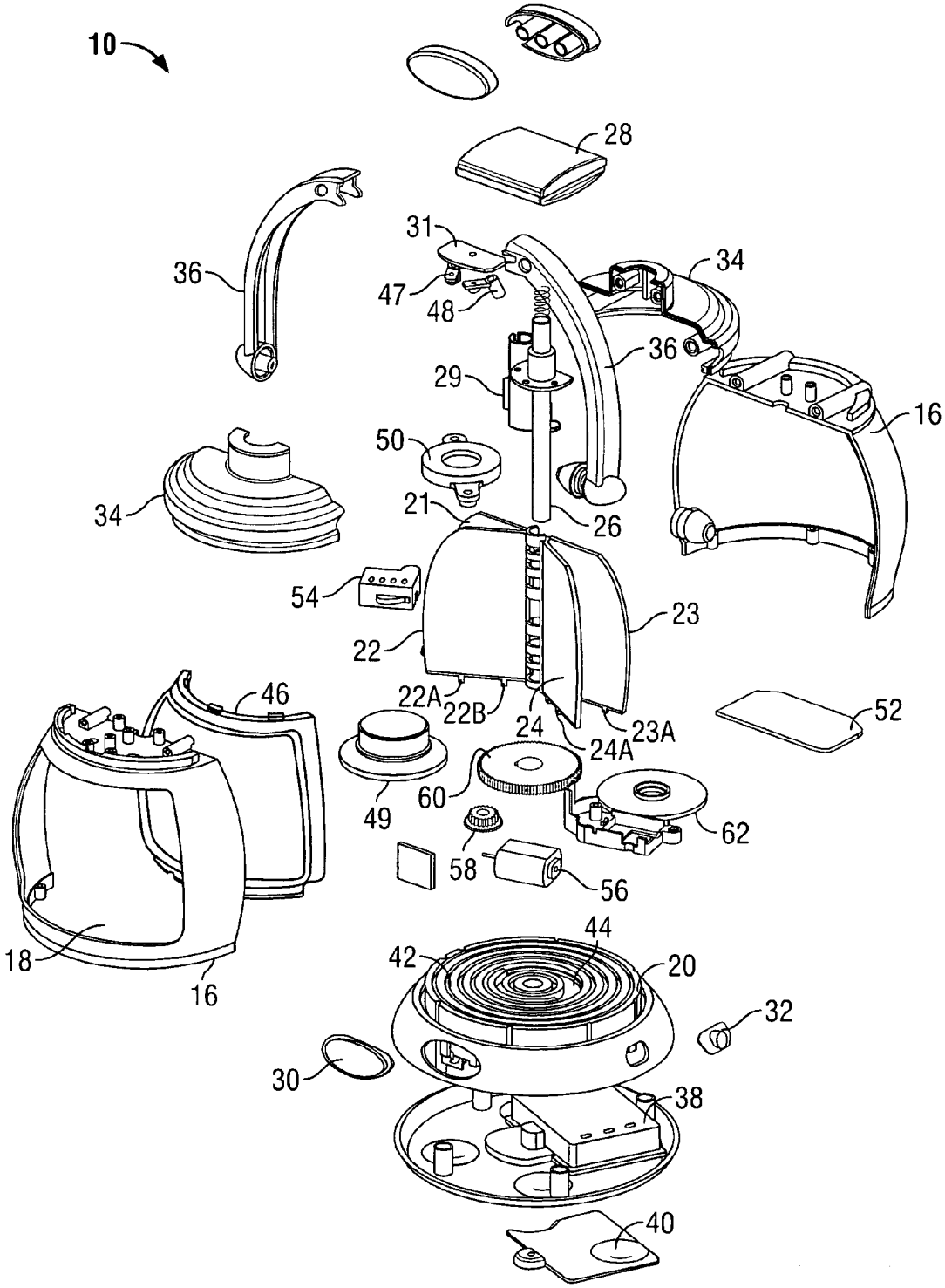
FIG. 2 is an exploded view of the toy of FIG. 1 showing the internal components.

Turning now to FIG. 2, the planar members are described in further detail. As shown, the plurality of planar members includes four planar members 21, 22, 23 and 24 that are sized and shaped to substantially correspond with the upper portion 16. Each of the planar members 21, 22, 23 and 24 includes one or more notched ring members. As shown in FIGS. 1 and 2, the ring members encircle the spindle 26 and permit the planar members 21, 22, 23 and 24 to rotate thereabout. Additionally, the notches on the ring members are arranged such that one planar member is rotatably engaged with diametrically opposing planar member (e.g., planar members 21 and 24 or planar members 22 and 23, as shown in FIG. 2). Furthermore, each planar member includes a first extension and a second extension, each extending downwardly towards the base 14.

The base 14 is sized and shaped to house a number of components including a drive mechanism, electronic circuitry and a power source. As shown in FIG. 2, the drive mechanism includes a motor 56, a pinion gear 58 and a drive gear 60. The drive mechanism components are fixably retained to the base portion 14 by drive mechanism cover 62. The electronic circuitry includes circuit board 52 that is operatively linked to the drive mechanism, a microswitch arrangement 54, a speaker 49, and one or more user-actuatable buttons or switches, such as 30 and 32. The power source for the toy 10 is preferably one or more disposable or rechargeable batteries. The one or more batteries are removably retained within battery chamber 38 by battery door 40. As shown, button 30 is an activation switch operatively linked to the circuit board 52 to activate the toy 10, and switch 32 is a mode switch for turning the toy 10 off, or selecting one or more modes of operation. Additionally, a planar member selector switch 31 is disposed within the cap 34 and is actuatable by applying a generally downward force to plunger 28 and attached plunger shaft 29. Planar member selector switch 31 is linked to the circuit board 52 in order to actuate the drive mechanism so that one or more desired planar members are viewable through the viewing portion 18.

The floor 20 of the top portion 16 includes a track having a plurality of concentric grooves 42, and a drive slot 44 along a portion of one groove 42. The first extension and second extension of each planar member (e.g., 22A and 22B) are sized, shaped, and spaced to travel within correspondingly spaced grooves 42. The microswitch arrangement 54 is affixed to the underside of the floor 20, and cutout portions are provided and aligned in the floor 20 so that each microswitch of the microswitch arrangement 54 corresponds with one groove 42 and one first extension (e.g., 21A, 22A, 23A and 24A). In this way, each planar member may be uniquely identified and recognized by the circuit board 52. Although the exemplary embodiment is shown as providing four planar members and a corresponding arrangement of first extensions, microswitches, and grooves, fewer or additional planar members are contemplated.

The second extensions of the planar members (e.g., 21B, 22B, 23B and 24B) are equidistantly spaced from the spindle 26 such that each second extension travels within the groove 42 having the drive slot 44. Drive slot 44 is an arcuate cutout along a portion of one groove 42 that allows the drive mechanism to rotatably advance the planar members. A drive element (not shown) may be affixed to the top of drive gear 60. When actuated, the drive mechanism operates so that drive gear 60 makes one full revolution. Consequently, during the full revolution, the drive element projects through the floor 20 within drive slot 44 and travels to drive one planar member approximately 180°. In response to the driven planar member, the diametrically opposing planar member travels somewhat less than 180°.

During the travel of the planar members, the first extension of one of the members actuates one microswitch of the microswitch arrangement 54 and the first side of that planar member becomes viewable through the viewing portion 18 along with a second side of a second member (e.g., for example, planar members 22 and 24 of FIGS. 1 and 2). Actuation of the microswitch identifies the displayed sides to the circuit board 52. Two or more lights, such as LEDs or the like, may be disposed in the cap 34 or top portion 16 and may additionally be positioned to illuminate the viewable planar members. As shown in FIG. 2, lights 47 and 48 are positioned above the viewable planar members 22 and 24. The lights are linked to circuit board 52 and may be individually or simultaneously illuminated.

The circuit board 52 may include a memory such as a RAM or ROM for storing a plurality of audio signals, each of the signals corresponding to each of the plurality of planar members. The audio signals may include music, sound effects, songs, speech and the like, relative to the images displayed on the planar members. The circuit board 52 may also include a microcontroller unit (MCU). The MCU, in communication with the memory, is operable to output audio signals to an output device such as speaker 49. Speaker 49 is a typical toy grade speaker and is retained within the base portion 14 by speaker retainer 50. Since the viewable planar members are physically adjacent and may be associated, such as two pages of a book, the MCU may likewise be programmed to associate the audio signals relative to the two viewable planar members. In view of the foregoing, the aforementioned lantern toy theme may be furthered with a book or story theme. To this end, plunger 28, as shown in FIGS. 1 and 2, may be sized and shaped to have the appearance of a storybook with a plurality of pages.

Figure 6:
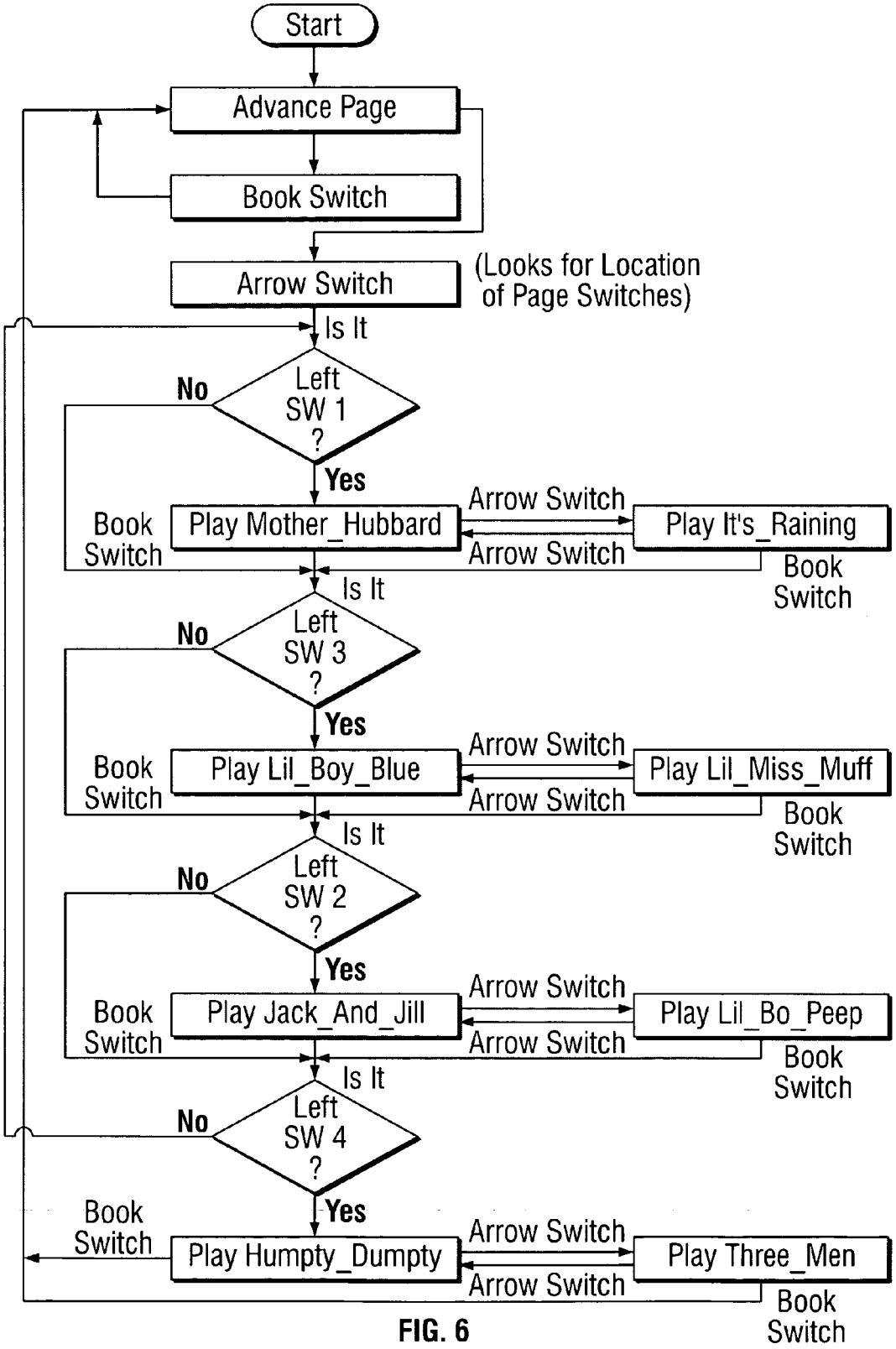
FIG. 6 is a flow diagram illustrating use of the toy in an interactive mode.

Relative to the aforementioned "storybook lantern" theme, it is desirable that the toy 10 includes one or more modes of operation. To this end, mode switch 32 is linked to circuit board 52 and is operable to select one of the modes of operation or, alternatively, turn the toy 10 off during extended periods of non-use or to conserve battery life. A first mode of operation is desired to be an interactive mode in which the toy 10 provides a child or other user with visual and auditory stimulation. As shown in FIG. 6, in the interactive mode, a child or other user first switches the mode switch 32 to the interactive mode, thereby advancing the planar members. The user then may select other planar members for viewing by actuating planar member selector switch 31 by pressing on plunger 28. Having displayed the desired adjacent planar members for viewing, the user may then proceed to activate the toy 10 by pressing activation button 30 on base 14. The activation button 30 may include a picture or other indicia that indicates its activation function (e.g., "arrow switch" of FIG. 6). Upon pressing the activation button 30, the circuit 52 is operable to output an audio signal (e.g., the Old Mother Hubbard nursery rhyme as shown in FIG. 6) via speaker 49 relative to the viewable first side of the first planar member (e.g., such as planar member 22 as shown in FIGS. 1 and 2), and simultaneously illuminate that planar member with first light 47. The audio signal is a predetermined duration, and upon completion of outputting the audio signal, the MCU may enter a "sleep" mode. The user may then proceed to press the activation button 30 again to output an audio signal (e.g., the It's raining it's pouring nursery rhyme as shown in FIG. 6) relative to the viewable second side of the second planar member (e.g., 24 of FIGS. 1 and 2), and simultaneously illuminate that page with second light 48. Upon completion, or prior to completion of the audio output, the user may press activation button 30 thereby toggling the audio output and lights between the two associated planar members (e.g., members 22 and 24). Alternatively, the user may actuate the planar member selector switch 31 (e.g., "book switch" of FIG. 6) via plunger 28, thereby interrupting the audio output, extinguishing the light, and actuating the drive mechanism to advance the planar members. Upon displaying two other adjacent planar members, the user may again press the activation button 30 and repeat the process with the different displayed members.

Figure 7:
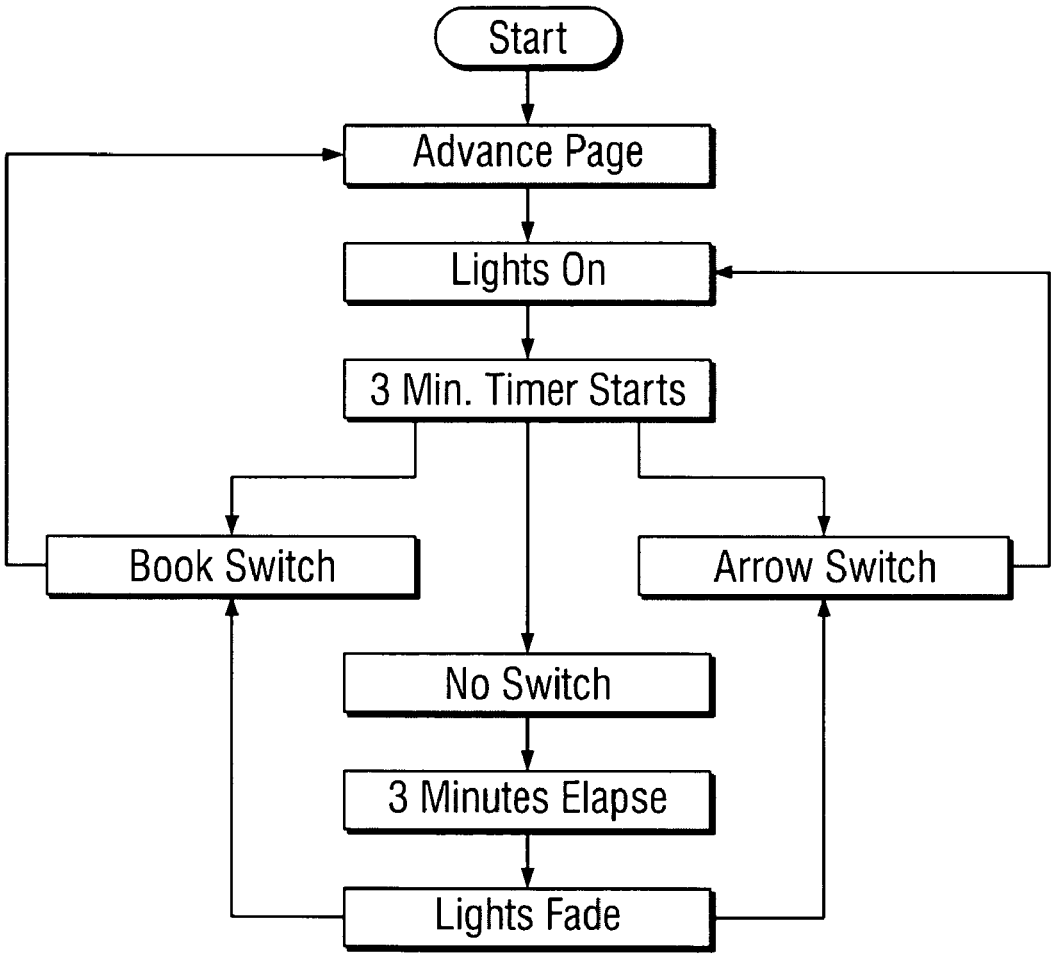
FIG. 7 is a flow diagram illustrating use of the toy in a nightlight mode.

In a second mode of operation, the toy 10 is operative to serve as a nightlight. Since the nightlight mode is contemplated to be used primarily at bedtime or naptime, audio output of the toy 10 is disabled to maintain a quiet environment. As shown in FIG. 7, upon selection of the nightlight mode via mode selector switch 32, the planar members advance by one planar member, and both lights 47 and 48 illuminate the viewable sides of the adjacent planar members. The lights remain illuminated for a predetermined time (e.g., three minutes) in accordance with a timing circuit or the like linked to the MCU, and then extinguish. After the lights 47 and 48 have extinguished, the user may press activation button 30 (e.g., "arrow switch") to re-illuminate the lights for another predetermined period of time, or may activate the planar member switch 31 (e.g., "book switch") by pressing plunger 28, thereby advancing the planar members by one planar member and re-illuminating the lights 47 and 48.

Figure 3:
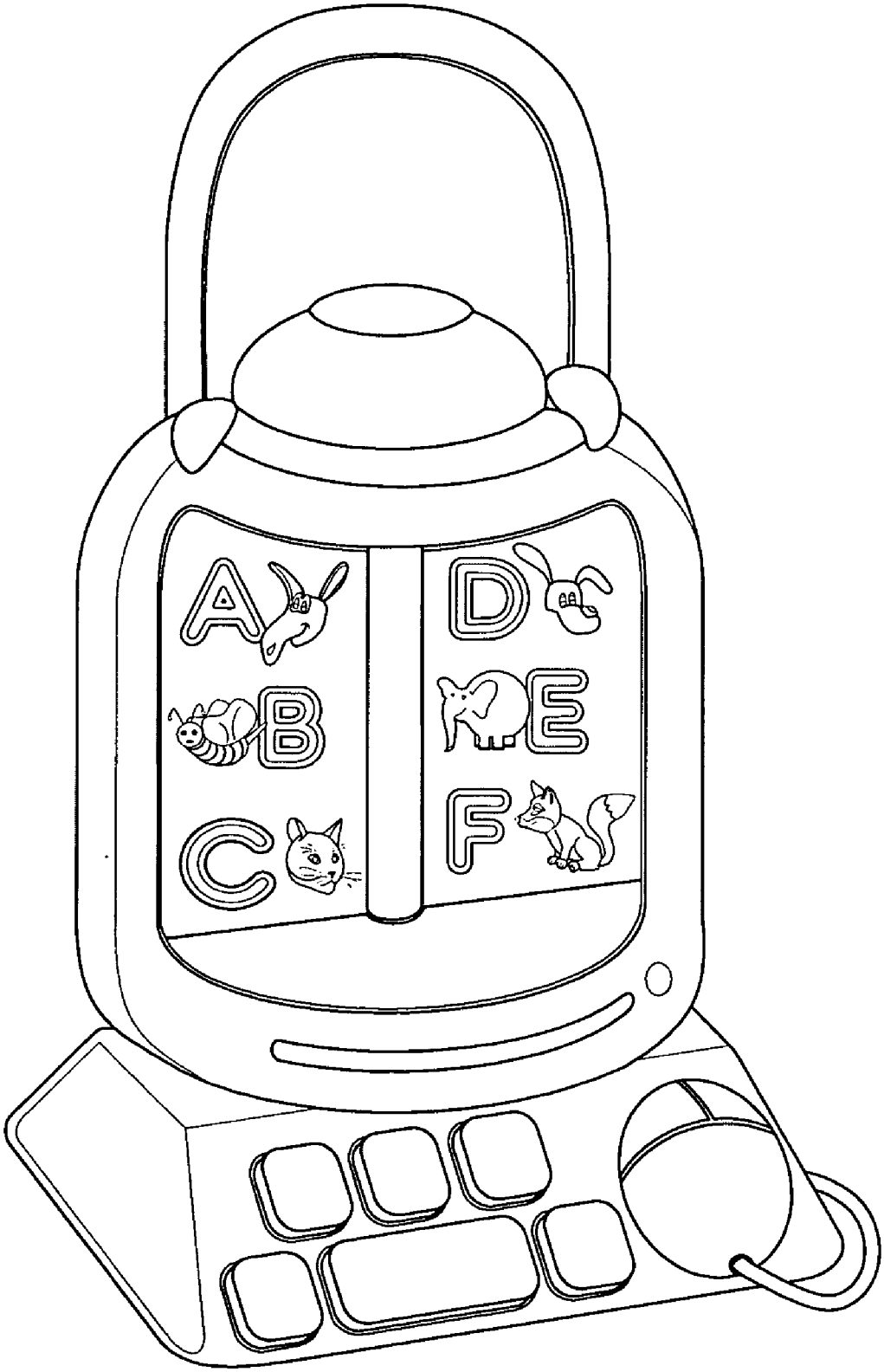
FIG. 3 is a perspective view of a second embodiment having a computer alphabet theme.
Figure 4:
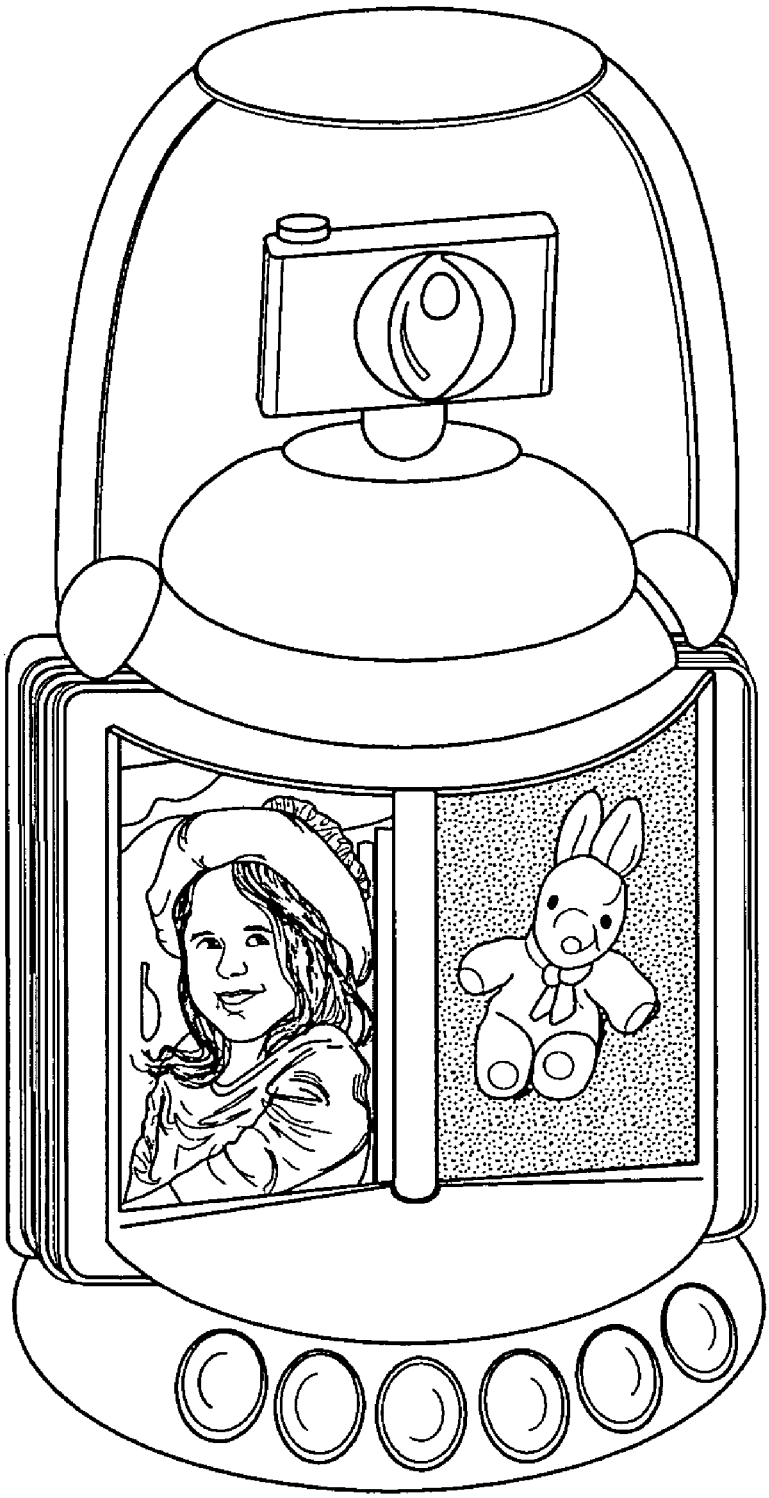
FIG. 4 is a perspective view of a third embodiment having a photo album theme.
Figure 5:
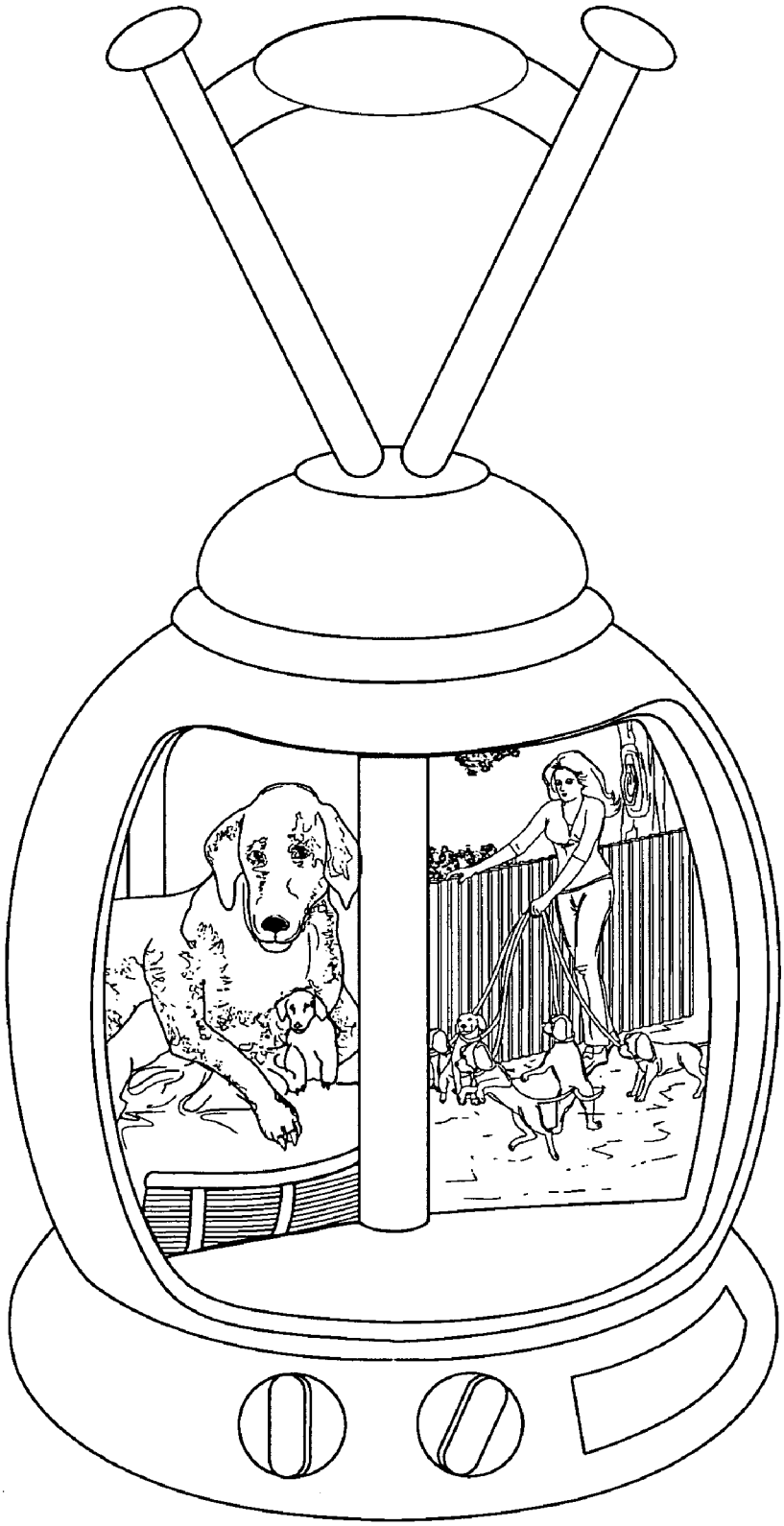
FIG. 5 is a perspective view of a fourth embodiment having a TV animal theme.

Although the first exemplary embodiment discussed above has a "storybook lantern" theme, other alternative themes may be contemplated by those in the art. Such alternative themes include a computer alphabet theme, such as that shown in FIG. 3 for teaching the letters of the alphabet, a photo album theme, such as that shown in FIG. 4 wherein the window 46 of FIG. 2 is omitted so that a user may customize the planar members with personal photographs or the like, and the TV animal theme, as shown in FIG. 5 wherein the toy may output animal sound effects and animal themed stories corresponding to animal pictures or images on the planar members. Moreover, other themes may include a geographic or a world theme that would tell stories about different places and people in the world, and may display maps and various geographic pictures. A Karaoke theme may illustrate lyrics of different songs, the songs may be output and, additionally, the user may be able to sing along with the songs using, for example, an attached microphone or the like. A jukebox theme may play different songs and show different musicians playing instruments or otherwise performing. Additionally, any one of the foregoing toys may be disposed within a plush doll having a see-through portion for displaying the planar members, and the buttons and switches may be disposed, for example, in the plush doll's limbs.

Preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A themed interactive toy comprising:

a housing having a base portion and a top portion;

a spindle disposed within the top portion;

a plurality of planar members drivably co-engaged about the spindle, each planar member having first and second sides for displaying images relative to a toy theme;

a drive mechanism disposed within the base portion and operable to advance the planar members about the spindle;

control circuitry operatively linked to the drive mechanism; and two or more lights for selectively illuminating one or more of the planar members, the lights selectively illuminated in response to the control circuitry.

2. The toy of claim 1 wherein the control circuitry comprises a microswitch arrangement, and each microswitch of the microswitch arrangement is actuatable by one of the planar members.

3. The toy of claim 2 wherein the top portion comprises a floor and the microswitch arrangement projects through a portion of the floor.

4. The toy of claim 3 wherein the floor further comprises:

a track having a plurality of concentric grooves; and a drive slot along a portion of one groove.

5. The toy of claim 4 wherein each of the planar members further comprises:

a first extension sized and shaped to travel within one of the concentric grooves and actuate one of the microswitches of the microswitch arrangement; and a second extension sized and shaped to travel within another of the concentric grooves having the drive slot, and engageable by the drive mechanism.

6. The toy of claim 5 wherein actuation of one of the microswitches by the first extension identifies the respective planar member to the control circuitry.

7. The toy of claim 6 wherein the top portion comprises:

a viewing portion for displaying at least a first side of a first planar member and a second side of an adjacent second planar member;

a first light positioned to illuminate the first side of the first planar member; and a second light positioned to illuminate the second side of the adjacent second planar member.

8. The toy of claim 7 wherein the control circuitry further comprises:

a speaker;

an activation switch for actuating one or more lights and the speaker;

a planar member selector switch for actuating the drive mechanism; and a mode switch for turning the device off or selecting a mode of operation.

9. The toy of claim 8 wherein the mode of operation comprises an interactive mode for outputting, relative to the viewable sides of the planar members, music and speech via the speaker, and further comprises a nightlight mode for illuminating the lights for a predetermined period of time.

10. The toy of claim 9 wherein, in the interactive mode, the activation switch toggles the output between music and speech relative to the first side of the first planar member, and music and speech relative to the second side of the adjacent second planar member.

11. The toy of claim 9 wherein, in the nightlight mode, the activation switch illuminates the first and second lights for a predetermined period of time.

12. The toy of claim 1 wherein the theme comprises a storybook.

13. The toy of claim 1 wherein the theme comprises the alphabet.

14. The toy of claim 1 wherein the theme comprises a photo album.

15. The toy of claim 1 wherein the theme comprises animals.

16. The toy of claim 1 wherein the theme comprises geography.

17. The toy of claim 1 wherein the theme comprises Karaoke.

18. The toy of claim 1 wherein the theme comprises a juke box.

19. An interactive plush toy wherein the toy in accordance with claim 1 is disposed within a plush doll having a see-through portion for displaying the planar members.

20. The toy of claim 19 wherein the plush doll comprises one or more limbs, and the activation and planar member selector switches are disposed in the limbs.

* * * * *